United States Patent [19]

Helm

[11] 4,003,183

[45] Jan. 18, 1977

[54] METHOD OF ENCLOSING INSERT MATERIAL IN A CONTINUOUSLY ADVANCING ENVELOPE BLANK

[75] Inventor: Herbert W. Helm, Hollidaysburg, Pa.

[73] Assignee: F. L. Smithe Machine Company, Inc., Duncansville, Pa.

[22] Filed: Oct. 16, 1974

[21] Appl. No.: 515,192

[52] U.S. Cl. ..... 53/31; 93/63 M

[51] Int. Cl.[2] ..... B65B 11/48

[58] Field of Search ..... 53/31, 206, 266 A, 117; 93/63 R, 63 M, 62

[56] References Cited

UNITED STATES PATENTS

| | | | |
|---|---|---|---|
| 2,131,428 | 9/1938 | Dalkowitz | 53/206 |
| 3,260,029 | 3/1966 | Wills | 53/117 X |
| 3,336,726 | 8/1967 | Mayer | 53/117 |
| 3,388,642 | 6/1968 | Berkley | 93/62 |
| 3,457,696 | 7/1969 | Berkley | 53/31 |
| 3,593,486 | 7/1971 | Helm | 53/31 |
| 3,594,976 | 7/1971 | Jackson | 53/31 |
| 3,643,555 | 2/1972 | Ehlscheid | 93/62 |
| 3,808,768 | 5/1974 | Dobbs | 53/206 |
| R25,961 | 2/1966 | Volks | 53/206 |

FOREIGN PATENTS OR APPLICATIONS

| | | | |
|---|---|---|---|
| 1,280,713 | 10/1968 | Germany | 53/31 X |

*Primary Examiner*—Travis S. McGehee
*Assistant Examiner*—J. Sipos
*Attorney, Agent, or Firm*—Stanley J. Price, Jr.; John M. Adams

[57] ABSTRACT

The envelope making and insert machine includes the forming of envelope blanks from an endless web or precut blanks and conveying the envelope blank upwardly along a vertical path to a folding station. The insert material is conveyed along a path that intersects the vertical path in timed relation with the envelope blank. The paths of the envelope blank and the insert material intersect at an angle adjacent the folding station. The envelope blank is engaged at the folding station by a vacuum cylinder, tucker, lifter or the like and is folded along the score line between the envelope blank body portion and bottom flap portion by the vacuum cylinder and a folding cylinder. The path of the envelope blank is changed from a vertical path to the path of the inserts during the folding operation. During the folding of the bottom flap into overlying relation with the blank body portion the insert material is inserted therebetween. The folded envelope blank with the insert material therebetween is thereafter conveyed to gumming and folding stations where adhesive is applied to the side flaps and top flap and the flaps are folded into overlying relation with the envelope blank bottom flap.

9 Claims, 8 Drawing Figures

METHOD OF ENCLOSING INSERT MATERIAL IN A CONTINUOUSLY ADVANCING ENVELOPE BLANK

BACKGROUND OF THE INVENTION

1. Field of the Invention

This invention relates to a method for enclosing insert material in an advancing envelope blank and more particularly to a method for enclosing insert material in an envelope blank by folding the envelope blank along a score line while inserting the insert material between the body and bottom flap portion of the blank.

2. Description of the Prior Art

U.S. Pat. No. 3,457,696 discloses a process for forming a mailing piece that includes an envelope having insert materials sealed therein. The insert materials are placed upon an advancing envelope blank and thereafter the envelope is formed by folding the flap portions around the insert material to form the completed mailing piece. U.S, Pat. No. Re.25,961 discloses a similar process wherein the various portions of the envelope blank are folded downwardly about a mailing insert.

U.S. Pat. No. 3,593,486 entitled "Method For Inserting Material In Envelope Blanks", assigned to the assignee of the instant application, discloses a method for enclosing insert materials in a continuously advancing envelope blank wherein the envelope blank is positioned on a rotating cylinder that has both vacuum and pressure ports. A negative pressure at the vacuum ports maintains the envelope blank in overlying contacting relation with the cylinder. A positive pressure at the pressure ports urges the bottom flap portion of the envelope blank away from the rotating cylinder to form a fold between the bottom flap and body portions of the envelope blank. Insert materials are injected into the fold and the bottom flap portion is thereafter folded into overlying relation with the blank body portion by continued rotation of the cylinder to enclose the insert materials therein.

Although the above method is a substantial improvement over the prior art processes for inserting materials in envelopes, the requisites of both vacuum and pressure ports and changing the direction of movement of the insert material limits the speed of the envelope forming machine.

SUMMARY OF THE INVENTION

This invention is directed to a method of enclosing insert materials in an advancing envelope blank that has a body portion and a bottom flap portion. The insert material is conveyed along a first course at a preselected speed. The envelope blank is conveyed along a second course to an intersection where the second course intersects the first course. A cylinder located adjacent to the intersection of the first and second courses is rotated at a preselected speed. Means are provided to change the direction of the envelope blank from the second course to the first course. The course of the envelope blank is changed from the second course to a third course and while changing courses the blank bottom flap portion is folded into overlying relation with the blank body portion. During the folding of the bottom flap portion insert material moving along the first course is inserted between the blank body portion and bottom flap portion. The folded envelope blank is then conveyed along the third course with the insert material therein for further processing.

The first course or path followed by the insert material is preferably normal to the second course or path followed by the envelope blank so that the paths intersect at a right angle and the third course is preferably a continuation of the first course followed by the insert material.

The envelope blank is conveyed to the intersection between the first course and the second course and the flap portion of the envelope blank passes through the intersection of the two courses and the blank body portion is engaged by the vacuum cylinder. Thus the flap portion is conveyed vertically past the vacuum cylinder and the body portion is the only portion of the envelope blank engaged by the vacuum cylinder. The envelope blank is folded along the score line between the body portion and the body flap portion by engaging the envelope blank body portion adjacent to the score line on the rotating vacuum cylinder by negative pressure in the vacuum ports. A folding cylinder having a diameter substantially smaller than the vacuum cylinder is positioned thereabove so that the envelope blank engaged by the vacuum cylinder passes between the vacuum cylinder and the folding cylinder positioned thereabove. With this arrangement the envelope blank is folded along the score line between the body portion and bottom flap portion and insert material is positioned therebetween. The envelope blank with the insert material positioned therein is thereafter conveyed along a third course where adhesive is applied to the flap portions and the flap portions are folded to form a sealed envelope with the insert material therein.

Accordingly, the principal object of this invention is to provide a method for enclosing insert material in a continuously advancing envelope blank wherein the insert material within the envelope blank or rectangular blank follows substantially the same path as the insert material fed to the envelope blanks.

Another object of this invention is to provide a method of enclosing insert material in a continuously advancing envelope blank wherein only a vacuum cylinder and a folding cylinder are required to fold the envelope blank while insert material is positioned therein.

These and other objects of this invention will be more completely described and disclosed in the following specification, the accompanying drawings and the appended claims.

DESCRIPTION OF THE PREFERRED EMBODIMENT

Figures 1, 2, 3, 4, 5, 6, 7, 8:
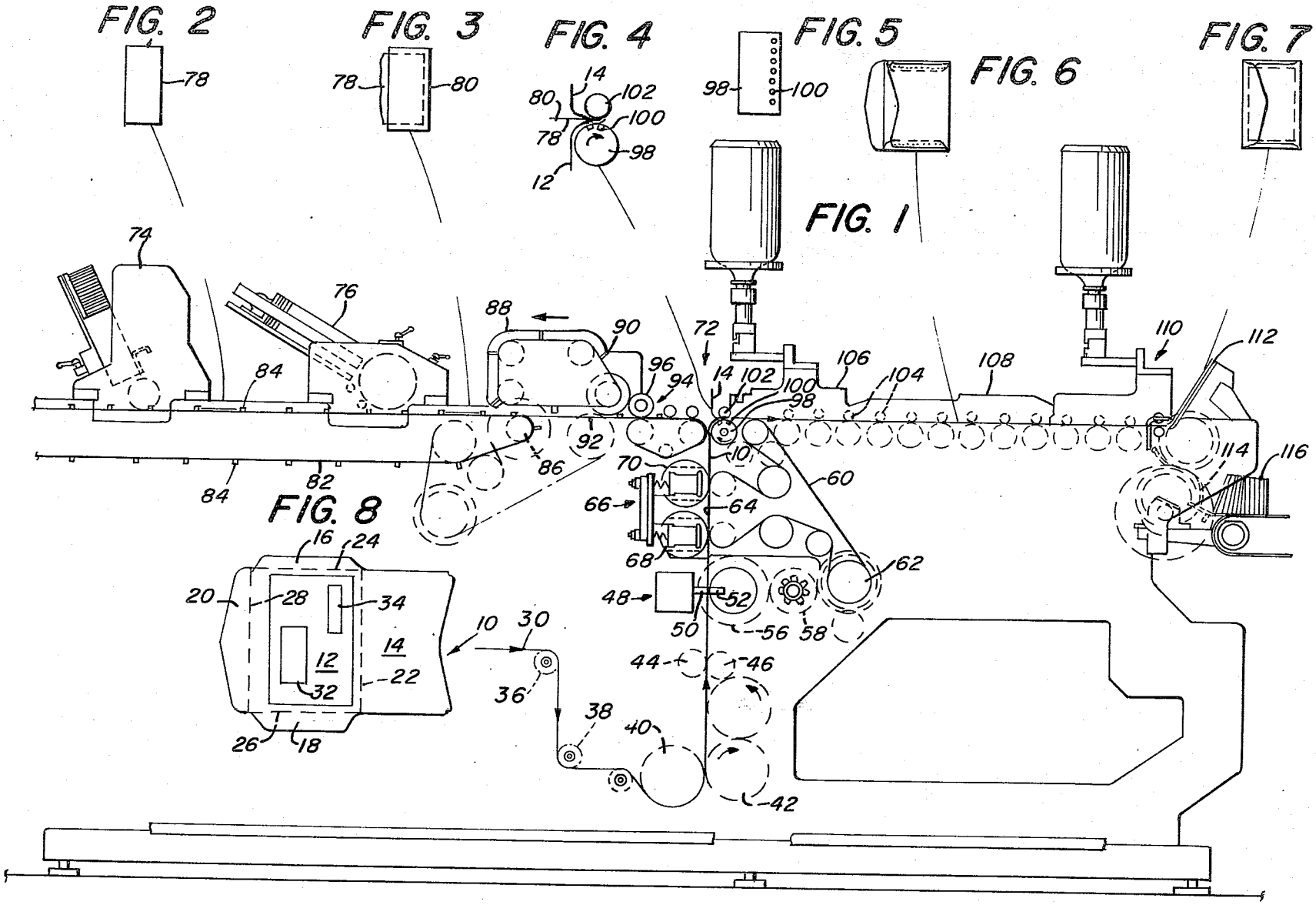
FIG. 1 is a fragmentary schematic representation of an envelope making machine in which inserts are positioned in the envelope blank as it is folded and adhesive is thereafter applied to the blank flap portions and the flap portions are folded to form an envelope containing the insert material.
FIGS. 2 and 3 diagrammatically illustrate the insert material conveyed toward the envelope blank folding mechanism.
FIG. 4 is an enlarged schematic view of the apparatus for folding the envelope blank while the insert material is positioned between the blank body portion and bottom flap portion.
FIG. 5 is a top plan view of the vacuum cylinder, illustrating the row of vacuum ports that engage the envelope blank body portion adjacent the score line between the body portion and bottom flap portion.
FIG. 6 is a diagrammatic view of the folded envelope blank with the insert material positioned therein and the side flap portions having adhesive material applied thereto and adhesively secured to the bottom flap portion.
FIG. 7 is a diagrammatic view of the formed and sealed envelope with the insert material positioned therein.
FIG. 8 is a top plan view of the envelope blank as it is conveyed upwardly toward the folding apparatus.

Referring to FIG. 8, the envelope blank generally designated by the numeral 10 has a body portion 12, a bottom flap portion 14, side flap portions 16 and 18 and a top flap portion 20. Score line 22 is formed between the body portion 12 and bottom flap portion 14. Likewise, score lines 24 and 26 are formed between the body portion 12 and side flaps 16 and 18. Another score line 28 is formed between the body portion 12 and top flap 20. The blank 10 may, on the other hand, be a scored rectangular blank.

The envelope blank is formed from an endless web of paper generally designated by the numeral 30. The web of paper is conveyed through a printer mechanism (not shown) where the front face of the envelope blank body portion may be printed and is then conveyed to a panel cutter station where panels indicated by the numerals 32 and 34 are cut in the web to form openings in the body portion of the envelope blank. Suitable translucent material is adhesively secured in overlying relation with the open panels 32 and 34 and the endless web is then conveyed to a side flap forming station. At the side flap forming station a pair of knives cut portions of the web side edges to form pairs of side flaps and the arcuate portions of the envelope top flap. Suitable apparatus for forming the side flaps is illustrated in U.S. Pat. No. 3,782,223. The endless web with the side flaps and the panels formed therein is then conveyed to a scoring station where the score lines 22, 24, 26 and 28 are formed in the endless web at appropriate locations thereon. The printer, panel cutter, side flap forming and scoring stations are not illustrated in FIG. 1. It should be understood that any suitable apparatus for performing the above function may be utilized at these respective stations. Where desired precut envelope blanks may be used in lieu of forming the blanks from a web.

As illustrated in FIG. 1, the endless web with the panels, side flap portions and score lines formed therein is conveyed around idler rolls 36 and 38 and conveyed to a pair of pull out rolls 40 and 42. The direction of the endless web is changed by the pull out rolls 40 and 42 from a generally horizontal path to a vertical path or course. The endless web is driven by a pair of drive rolls 44 and 46 to a cut off device generally indicated by the numeral 48. The cut off device includes a stationary knife 50 and a knife blade 52 mounted on a rotating cylinder 54. The cylinder 54 is driven through suitable gearing 56 and 58 in timed relation to cut the web along a line that forms the adjacent lower edge of the bottom flap 14 and the upper edge of the seal flap 20 to thus form separate envelope blanks as illustrated in FIG. 8.

An endless timing belt 60 is reeved about suitable rolls including a drive roll 62 and is arranged to drive the rolls about which it is reeved. A speed up roll generally designated by the numeral 66 includes a pair of rolls 68 and 70 that have arcuate portions arranged to engage the envelope blank and accelerate the envelope blank along the vertical course upwardly into the folding station generally designated by the numeral 72.

Positioned above the web 30 are a plurality of insert stations 74 and 76 that are arranged to discharge insert material, such as cards 78 and 80, therefrom in timed relation to the movement of the envelope blanks. An aligner chain 82 extends beneath the insert stations 74 and 76 and includes a plurality of upward stop members 84 positioned in spaced relation on aligner chain 82. The inserts 78 and 80 delivered in the insert stations 74 and 76 are positioned between the stop members 84 on the aligner chain 82 and are conveyed toward the folding station 72. The aligner chain 82 is reeved about an end roller 86 which is in overlying relation with a similar aligner chain 88.

The aligner chain 88 has downwardly extending members 90 that are arranged to pick up and convey the plurality of inserts along a horizontal path toward the folding station 72 on a support member 92. The inserts are conveyed by the aligner chain 88 to a feed belt 94 that has a rotating feed cylinder 96 positioned in overlying relation therewith. The cylinder 96 is preferably rotating at an accelerated speed and accelerates the insert material horizontally toward the folding station 72.

At the folding station 72 there is a vacuum roll 98 that has a line of vacuum ports 100 that extend longitudinally across the roll 98. Positioned above and in abutting contact with the vacuum roll 98 is a folding cylinder or other suitable idler rolls. The vacuum roll 98 and folding cylinder 102 with the vacuum ports 100 are illustrated in greater detail in FIGS. 4 and 5.

As the envelope blank 10 moves vertically upwardly and intersects the path or course followed by the insert material the bottom flap portion 14 moves through the intersection of the two paths and the envelope blank body portion is engaged adjacent the score line 22 between the body portion 12 and bottom flap portion 14 by the negative pressure exerted in the vacuum ports 100. Thus, the bottom flap portion 14 moves upwardly beyond the intersection and continues to do so until the vacuum ports 100 engage the envelope blank body portion.

The vacuum cylinder 98 and folding cylinder 102 rotate at a preselected speed and change the path or course of the envelope blank from a vertical path to a generally horizontal path and fold the envelope blank along the score line 22. Although a folding cylinder 102 is illustrated in operative relation with the vacuum cylinder 98 it should be understood that other suitable folding devices, such as an endless belt or an idler roller, may be employed. As the envelope blank is engaged by the vacuum cylinder 98 a pair of inserts 78 and 80 are projected horizontally by the cylinder 96 so that they intersect the score line 22 as the envelope blank is being folded by the vacuum cylinder 98 and folding cylinder 102. The folded envelope blank with the insert material positioned between the bottom flap portion and the body portion is then conveyed by suitable idler pulleys 104 to a gumming station generally designated by the numeral 106 where gum or adhesive is applied to the side flaps 16 and 18 as illustrated in FIG. 6. For bulky inserts idlers may be replaced by suitably driven upper belts. The envelope blank with the insert material therein is thereafter conveyed to a folding station 108 where the side flaps 16 and 18 are folded into overlying relation with the bottom flap 14. Thereafter, the top flap 20 has adhesive applied thereto at a second gumming station 110 and is then conveyed to a folder 112 where the seal flap 20 is positioned in overlying relation with the bottom flap 14 to form a sealed envelope with the insert material therein. The envelopes with the insert material therein are thereafter conveyed by means of a collator 114 to a stack 116.

With the above arrangement an envelope blank 10 is severed from an endless web 30 as it moves upwardly along a vertical path. The envelope blank is accelerated and the bottom flap portion 14 passes through an intersection between the vertical path of the envelope blank and the horizontal path or course followed by the insert materials. At the folding station 72 the envelope blank is folded along the score line 22 by the vacuum cylinder 98 and folding cylinder 102 and simultaneously during the folding operation the insert material is projected into the folder as the envelope blank changes path or direction from a vertical path or course to a horizontal path substantially the same as the path followed by the insert material. With this arrangement a vacuum cylinder and folding cylinder are the only elements required to fold the envelope blank and the insert material is positioned therebetween during the folding operation. Although the path of the envelope blanks is indicated as a vertical path and the path of the insert material and the folded envelope blank is indicated as a horizontal path, it should be understood that the courses or paths may deviate from the paths illustrated without affecting the operation of the hereinabove described folding mechanism. Further, the path followed by the folded envelope blank does not necessarily have to be the same as that followed by the insert material.

According to the provisions of the patent statutes, I have explained the principle, preferred construction and mode of operation of my invention and have illustrated and described what I now consider to represent its best embodiments.

I claim:

1. A method of enclosing insert material in a continuously advancing blank having a body portion and a bottom flap portion comprising, conveying insert material along a first straight line path at a preselected speed, continuously conveying a blank along a second straight line path to an intersection where a second straight line path intersects said first straight line path, rotating a vacuum cylinder having vacuum ports thereon at a location adjacent to said intersection of said first straight line path and said second straight line path, while said blank is being conveyed along said second straight line path, engaging the body portion of said blank to said vacuum cylinder by means of a negative pressure through said vacuum ports at a location on said blank adjacent said bottom flap portion and folding said blank bottom flap portion into overlying relation with said blank body portion, inserting insert material between said blank body portion and bottom flap portion while said blank is being folded and conveyed, and thereafter conveying said folded blank with said insert material positioned therein along a third straight line path substantially aligned with said first straight line path.

2. A method of enclosing insert material in a continuously advancing blank having a body portion and a bottom flap portion as set forth in claim 1 which includes, changing the direction of said blank by said rotating vacuum cylinder from said second straight line path to said third straight line path and folding said blank bottom flap portion into overlying relation with said blank body portion.

3. A method for enclosing insert material in a continuously advancing blank as set forth in claim 1 which includes, conveying said blank bottom flap portion along said second straight line path through said intersection and engaging said blank body portion to said vacuum cylinder.

4. A method for enclosing insert material in a continuously advancing blank as forth in claim 1 in which, said blank includes a score line between said blank body portion and bottom flap portion, engaging said blank body portion closely adjacent to said score line and folding said blank along said score line while said blank body portion remains engaged to said vacuum cylinder.

5. A method for enclosing insert material in a continuously advancing blank as set forth in claim 1 which includes, conveying said insert material along said first straight line path at a preselected speed and simultaneously inserting said insert material between said blank body portion and bottom flap portion while folding said blank bottom flap portion into overlying relation with said blank body portion.

6. A method for enclosing insert material in a continuously advancing blank as set forth in claim 4 which includes, conveying said insert material along said first straight line path in timed relation to said blank so that the leading edge of insert material abuts said score line between said blank body portion and bottom flap portion.

7. A method for enclosing insert material in a continuously advancing blank as set forth in claim 1 in which, said first straight line path of said insert material is substantially horizontal.

8. A method for enclosing insert material in a continously advancing blank as set forth in claim 7 in which, said second straight line path followed by said blank is substantially vertical.

9. A method for enclosing insert material in a continuously advancing blank as set forth in claim 8 in which, the angle between said first straight line path and said second straight line path is about 90°.

* * * * *